US007728736B2

(12) United States Patent
Leeland et al.

(10) Patent No.: US 7,728,736 B2
(45) Date of Patent: Jun. 1, 2010

(54) COMBUSTION INSTABILITY DETECTION

(75) Inventors: Shanna L. Leeland, St. Paul, MN (US); Brent Chian, Plymouth, CA (US)

(73) Assignee: Honeywell International Inc., Morristown, NJ (US)

( * ) Notice: Subject to any disclaimer, the term of this patent is extended or adjusted under 35 U.S.C. 154(b) by 342 days.

(21) Appl. No.: 11/741,435

(22) Filed: Apr. 27, 2007

(65) Prior Publication Data

US 2008/0266120 A1 Oct. 30, 2008

(51) Int. Cl.
*G08B 17/12* (2006.01)
*F23N 5/26* (2006.01)
*F21N 5/08* (2006.01)

(52) U.S. Cl. ..... 340/578; 431/14; 431/79

(58) Field of Classification Search ..... 340/628–630, 340/577–579; 431/13–17, 77–85
See application file for complete search history.

(56) References Cited

U.S. PATENT DOCUMENTS 3,909,816 A 9/1975 Teeters
4,157,506 A 6/1979 Spencer
4,221,557 A 9/1980 Jalics
4,483,672 A 11/1984 Wallace et al.
4,555,800 A * 11/1985 Nishikawa et al. ..... 382/203
4,655,705 A 4/1987 Shute et al.
4,695,246 A 9/1987 Beilfuss et al.
4,709,155 A * 11/1987 Yamaguchi et al. ..... 250/554
4,830,601 A 5/1989 Dahlander et al.
4,842,510 A 6/1989 Grunden et al.
4,872,828 A 10/1989 Mierzwinski
4,904,986 A * 2/1990 Pinckaers ..... 340/578
4,955,806 A 9/1990 Grunden et al.
5,037,291 A 8/1991 Clark
5,077,550 A 12/1991 Cormier
5,112,117 A 5/1992 Ripka et al.
5,126,721 A 6/1992 Butcher et al.
5,158,477 A 10/1992 Geary
5,175,439 A 12/1992 Harer et al.
5,222,888 A 6/1993 Jones et al.
5,236,328 A 8/1993 Tate et al.
5,255,179 A 10/1993 Zekan et al.
5,280,802 A 1/1994 Comuzie, Jr.

(Continued)

FOREIGN PATENT DOCUMENTS

EP 0967440 12/1999

(Continued)

OTHER PUBLICATIONS www.playhookey.com, "Series LC Circuits," 5 pages, printed Jun. 15, 2007.

(Continued)

*Primary Examiner*—Jennifer Mehmood
(74) *Attorney, Agent, or Firm*—Crompton Seager & Tufte LLC

(57) ABSTRACT

Combustion instability in combustion appliances may be recognized before excessive carbon monoxide may be produced. In some instances, combustion instability may be manifested in flame oscillation, or rather, in oscillations in flame intensity as measured, for example, by a flame sensor. If flame instability is detected, appliance operation may be corrected or terminated.

6 Claims, 8 Drawing Sheets

U.S. PATENT DOCUMENTS

| | | | | |
|---|---|---|---|---|
| 5,347,982 | A | 9/1994 | Binzer et al. | |
| 5,391,074 | A | 2/1995 | Meeker | |
| 5,424,554 | A | 6/1995 | Marran et al. | |
| 5,506,569 | A | 4/1996 | Rowlette | |
| 5,567,143 | A | 10/1996 | Servidio | |
| 5,797,358 | A | 8/1998 | Brandt et al. | |
| 5,971,745 | A * | 10/1999 | Bassett et al. | 431/12 |
| 6,060,719 | A | 5/2000 | DiTucci et al. | |
| 6,071,114 | A * | 6/2000 | Cusack et al. | 431/79 |
| 6,084,518 | A | 7/2000 | Jamieson | |
| 6,222,719 | B1 | 4/2001 | Kadah | |
| 6,278,374 | B1 * | 8/2001 | Ganeshan | 340/578 |
| 6,299,433 | B1 | 10/2001 | Gauba et al. | |
| 6,509,838 | B1 | 1/2003 | Payne et al. | |
| 6,743,010 | B2 | 6/2004 | Bridgeman et al. | |
| 6,794,771 | B2 | 9/2004 | Orloff | |
| 7,289,032 | B2 * | 10/2007 | Seguin et al. | 340/578 |
| 2002/0099474 | A1 | 7/2002 | Khesin | |
| 2003/0064335 | A1 | 4/2003 | Canon | |
| 2004/0209209 | A1 | 10/2004 | Chodacki et al. | |
| 2006/0017578 | A1 * | 1/2006 | Shubinsky et al. | 340/578 |

FOREIGN PATENT DOCUMENTS

| | | |
|---|---|---|
| EP | 1148298 | 10/2001 |
| WO | 9718417 | 5/1997 |

OTHER PUBLICATIONS

Honeywell, "S4965 SERIES Combined Valve and Boiler Control Systems," 16 pages, prior to the filing date of present application, Mar. 2002.

Honeywell, "SV9410/SV9420; SV9510/SV9520; SV9610/SV9620 SmartValve System Controls," Installation Instructions, 16 pages, 2003.

* cited by examiner

COMBUSTION INSTABILITY DETECTION

TECHNICAL FIELD

The present disclosure pertains generally to combustion appliances and more particularly to combustion appliances that may be susceptible to combustion instability.

BACKGROUND

A variety of combustion appliances burn combustible fluids such as natural gas, propane, fuel oil and the like, in order to provide heat and/or light. Examples of combustion appliances include gas water heaters, gas clothes dryers, as stoves, ovens, gas grills, gas fireplaces, forced air furnaces, gas or oil fueled boilers for hot water heating systems, and the like. A combustion appliance may include a combustion chamber in which the fuel is burned, and the combustion gases may be vented through a flue.

In many cases, proper combustion results in a relatively low amount of undesirable gases such as carbon monoxide. However, improper combustion, which may result from a variety of potential causes, may have undesired results, such as excessive carbon monoxide production. While these combustion gases are ideally all vented out the flue, it will be recognized that in some cases this may not occur completely. Thus, it may be desirable to recognize, and recognize quickly, if and when improper combustion may be occurring, so that combustion can be corrected or, if necessary, terminated.

A need remains, therefore, for methods of recognizing and detecting combustion instability in combustion appliances.

SUMMARY

The present disclosure pertains to methods of recognizing combustion instability in combustion appliances. In some instances, combustion instability may be indicated by significant fluctuations in flame intensity as measured, for example, by a flame sensor. These and other irregularities in flame intensity can be detected, possibly indicating an improper combustion condition, and appropriate actions can be taken.

The above summary of the present disclosure is not intended to describe each disclosed embodiment or every implementation of the present disclosure. The Figures and Detailed Description that follow more particularly exemplify these embodiments.

BRIEF DESCRIPTION OF THE FIGURES

The disclosure may be more completely understood in consideration of the following detailed description of various embodiments of the invention in connection with the accompanying drawings, in which.

Figure 1:
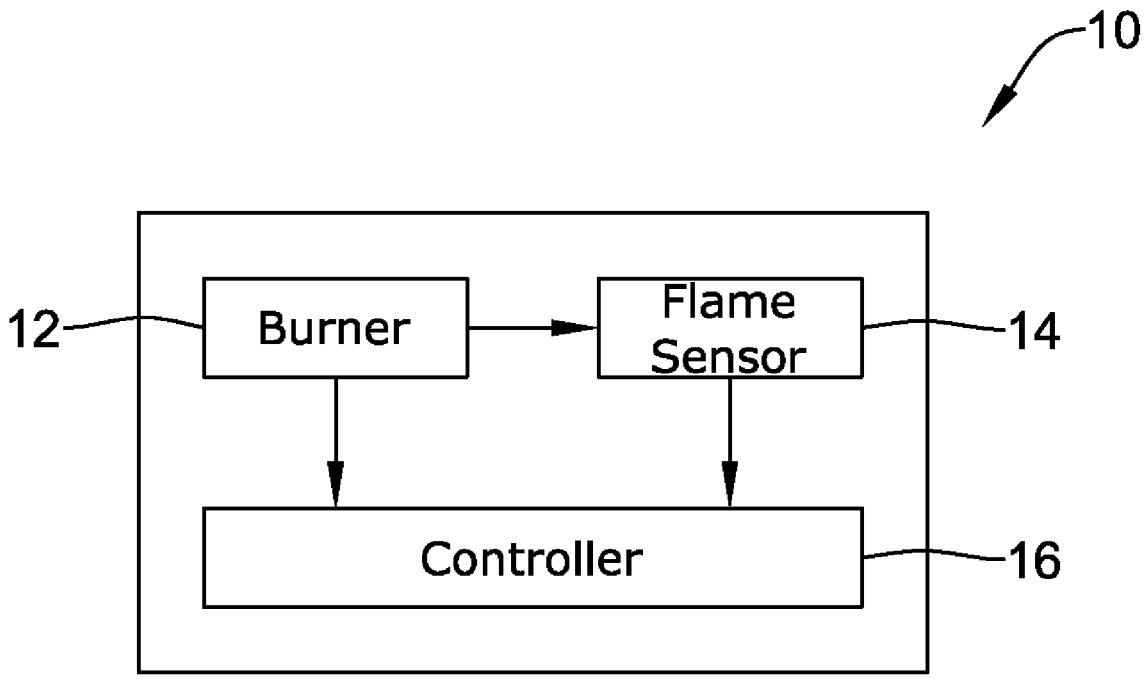
FIG. 1 is a block diagram of an illustrative but non-limiting combustion appliance.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

While in some instances, the disclosure may be described with respect to combustion appliances such as a forced air furnace, this is merely for illustrative purposes. It should be recognized that the disclosure pertains equally to other controller-controlled combustion appliances. FIG. 1 shows a combustion appliance 10 that may, as indicated, represent a forced air furnace. Combustion appliance 10 includes a burner 12 and a flame sensor 14. Flame sensor 14 may be configured and/or disposed appropriately to provide a signal such as an electrical signal that provides some indication of a flame quality provided by burner 12. In some cases, flame sensor 14 may provide a current that is proportional or substantially proportional to flame intensity, but this is not required.

More generally, flame sensor 14 may be any type of sensor that is capable of detecting and/or quantifying a flame. For example, flame sensor 14 may be an optical sensor such as a cadmium sulfide flame sensor, a flame ionization sensor, or any other suitable flame sensor, as desired.

In some cases, flame sensor 14 may be an optical device that has an electrical characteristic that changes when light is incident on a window or other area of the flame sensor. Although not limiting, one such flame sensor includes a resistive element that varies in resistance in response to visible or other wavelengths of light (e.g. a microbolometer). Flame sensor 14 may provide a voltage, current, frequency, or any other suitable output signal, as desired. Semi-conducting devices and/or photodiodes may also be used, as well as non-optical devices such as heat sensitive devices, if desired.

In some instances, flame sensor 14 is adapted to provide a quantitative output. For example, one quantitative output would be a resistance value that, in response to light, varies from 300 ohms to 500 ohms of resistance. Other examples include an avalanche photodetector that outputs a current in response to incident light, or a phototransistor that receives light at the base of a bipolar junction transistor. As noted above, the quantitative output may take on a number of forms including resistance, voltage, current, frequency, or any other suitable form, as desired.

Combustion appliance 10 may, in some cases, include a controller 16. Controller 16 may be adapted to regulate burner 12 by providing appropriate electrical or other signals to burner 12, and/or to a gas valve (not shown) that provides fuel to burner 12. If combustion appliance 10 is a forced air furnace, controller 16 may be configured to communicate with an external HVAC controller such as a zone control panel and/or one or more thermostats. If the external HVAC controller issues a HEAT call, for example, controller 16 may provide appropriate commands to burner 12. In other applications, controller 16 may be adapted to accept inputs from a user and translate these inputs into appropriate burner commands.

In some cases, controller 16 may be adapted to receive signals from flame sensor 14. In some instances, controller 16 may be programmed with one or more algorithms that may permit controller 16 to interpret flame signals from flame sensor 14 and thereby detect combustion instability before the combustion instability reaches an unsafe level. For example, flame sensor 14 may provide controller 16 with an electrical signal that is proportional to flame intensity. If the flame intensity changes significantly, this may be an indication of improper or unstable combustion that may be caused by, for example, a change in flue pressure and/or a fuel/air ratio that is becoming either too rich or too lean.

In some cases, combustion instability may be manifested in a dancing flame. While a proper flame may have an intensity that oscillates slightly, this oscillation (if present) can have a relatively low amplitude and a relatively high frequency. An improper, or dancing, flame may have an intensity that oscillates at a relatively lower frequency but at a higher amplitude, dependant at least in part upon firing rate. An unsafe or potentially unsafe flame condition may, therefore, be detected by monitoring and analyzing a signal from flame sensor 14.

In some cases, the flame sensor signal may be monitored for indications that an amplitude of the flame intensity is changing relatively quickly. An improper flame may, for example, have an amplitude that can vary by a value that can be as much as five percent or more of an average amplitude. In some cases, an amplitude of an unstable flame may vary by an even greater amount. One or more relatively large changes in flame intensity may be an indication of improper combustion.

Flame intensity oscillation may also be an indicator of improper combustion. As such, and in some instances, the flame sensor signal may be monitored for indications that a sign of the flame intensity has changed. A sign change may indicate that the flame intensity has stopped increasing and has started decreasing and/or that the flame intensity has stopped decreasing and has started increasing. In some instances, sign changes in flame intensity, such as during flame oscillation, may be an indication of improper combustion. Some illustrative algorithms will be discussed with respect to subsequent Figures.

Figure 2:
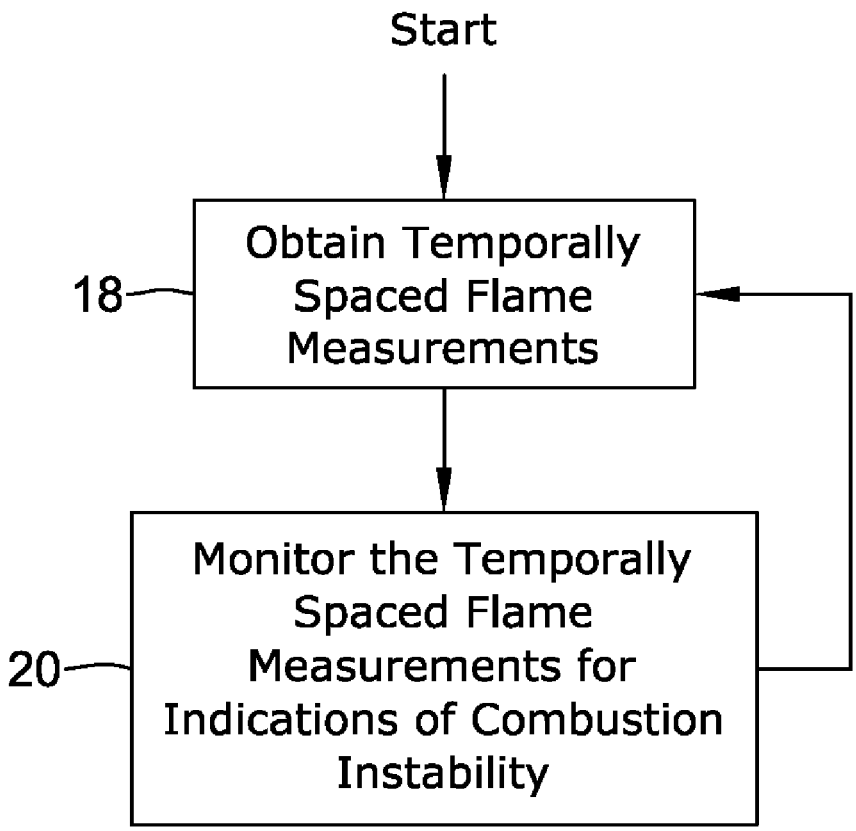
FIG. 2 is a flow diagram showing an illustrative method that may be carried out in operating the illustrative combustion appliance of FIG. 1.

FIG. 2 is a flow diagram showing an illustrative method that may be carried out using combustion appliance 10 (FIG. 1). At block 18, temporally spaced flame measurements may be obtained. The temporally spaced flame measurements may be obtained at any desired time interval. For example, a flame measurement may be obtained every second, every 0.5 seconds, or at any other desired interval. The time interval may be uniform, or the sampling frequency may be varied. In some instances, a flame measurement may be obtained from flame sensor 14 (FIG. 1). Control passes to block 20, where the temporally spaced flame measurements obtained at block 18 are monitored for indications of combustion instability. In some cases, control reverts back to block 18 and the process continues.

Figure 3:
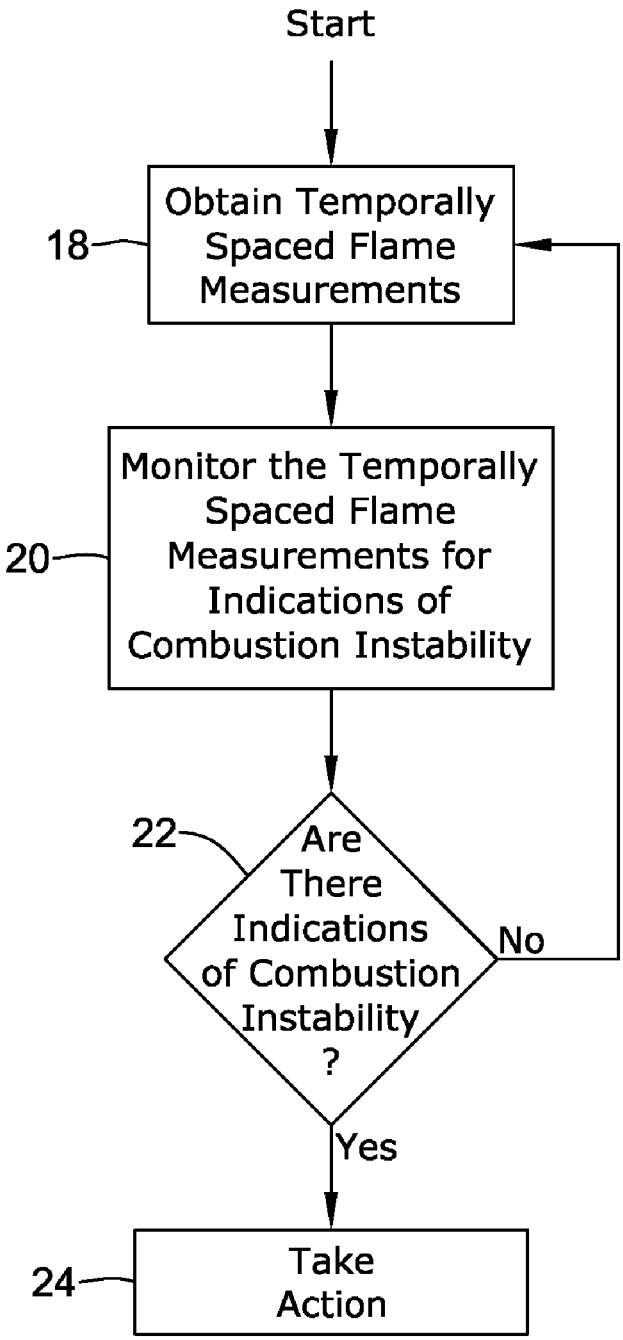
FIG. 3 is a flow diagram showing an illustrative method that may be carried out in operating the illustrative combustion appliance of FIG. 1.

FIG. 3 is a flow diagram showing an illustrative method that may be carried out using combustion appliance 10 (FIG. 1). At block 18, temporally spaced flame measurements may be obtained. In some instances, flame measurements may be obtained from flame sensor 14 (FIG. 1). Control passes to block 20, where the temporally spaced flame measurements obtained at block 18 are monitored for indications of combustion instability.

At decision block 22, controller 16 (FIG. 1) determines if there are indications of combustion instability. In some instances, this determination may be based at least in part on the temporally spaced flame measurements obtained at block 18. If no indications of combustion instability are detected or otherwise observed, control reverts back to block 18. However, if there are indications of combustion instability, control passes to block 24 where one or more actions may be taken. In some cases, it may be possible to correct the combustion instability by changing one or more functional parameters such as firing rate, combustion fan speed and the like.

In some cases, combustion may be stopped, either before and/or after attempting to correct the combustion instability. In some cases, combustion appliance 10 may remain off until a service professional can attend to it. In some instances, it is contemplated that combustion appliance 10 may be off for only a short period of time before a user is able to reset it, or the system may reset itself after a period of time.

Figure 4:
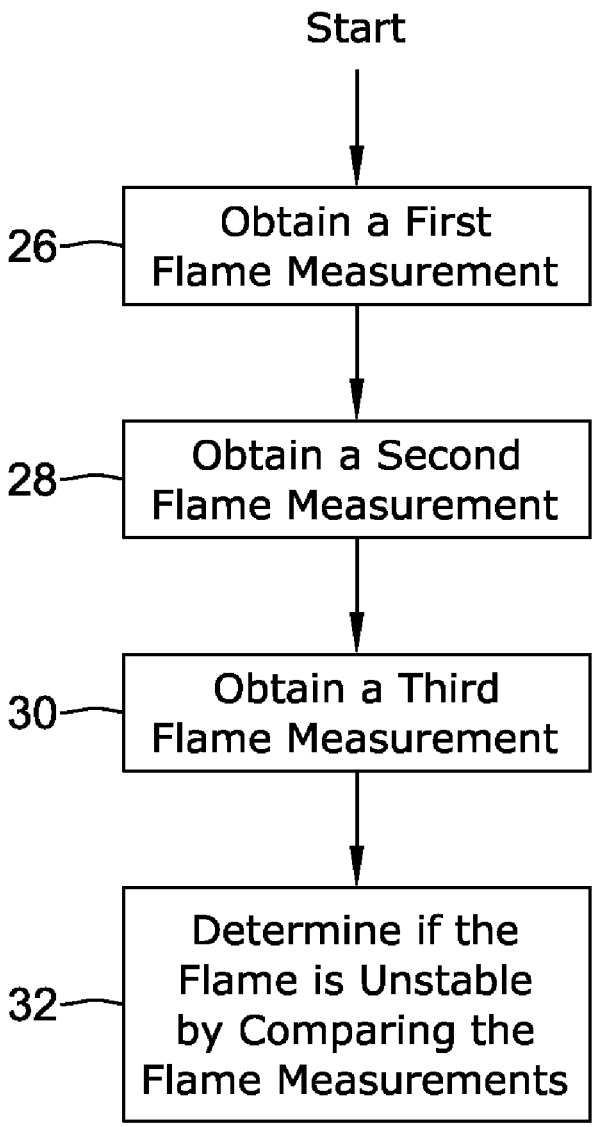
FIG. 4 is a flow diagram showing an illustrative method that may be carried out in operating the illustrative combustion appliance of FIG. 1.

FIG. 4 is a flow diagram showing an illustrative method that may be carried out using combustion appliance 10 (FIG. 1). At block 26, a first flame measurement is obtained. In some cases, controller 16 (FIG. 1) may capture or otherwise obtain a flame signal from flame sensor 14 (FIG. 1), but this is not required. At block 28, a second flame measurement is obtained at some time subsequent to a time at which the first flame measurement was obtained at block 26. Control passes to block 30, where a third flame measurement is obtained. As can be seen, a series of flame measurements may be obtained.

In some cases, the second flame measurement (obtained at block 28) may be a flame measurement obtained next in line after obtaining the first flame measurement (block 26). In some instances, one or more flame measurements may be discarded or otherwise not used between obtaining the first flame measurement (block 26) and obtaining the second flame measurement (block 28). Similarly, there may or may not be one or more discarded flame measurements between the second flame measurement (block 28) and the third flame measurement (block 30). In this, first, second and third are used to denote relative order, and should not be construed as requiring that first, second and/or third flame measurements be completely sequential (e.g. one directly after the other).

At block 32, controller 16 (FIG. 1) determines if a flame is unstable by comparing the flame measurements previously obtained. In some cases, determining if the flame is unstable may include calculating if a difference between the first flame measurement and the second flame measurement and/or a difference between the second flame measurement and the third measurement is greater than a predetermined threshold. The predetermined threshold may, for example, be a function of an average flame measurement and/or may be determined at least in part based on the operating characteristics of combustion appliance 10 (FIG. 1).

In some instances, determining flame instability may include calculating whether the second flame measurement is greater or less than the first flame measurement and whether the third flame measurement is greater or less than the second flame measurement. In some cases, controller 16 (FIG. 1) may determine that the flame is unstable based at least in part on whether or not the second flame measurement is sufficiently greater than the first flame measurement and/or sufficiently greater than the third flame measurement. Alternatively, or in addition, flame instability may be determined, for example, if the second flame measurement is sufficiently less than the first flame measurement and/or sufficiently less than the third flame measurement. In some cases, these are indications of a sign change which may, as discussed above, indicate an unstable flame.

Figure 5:
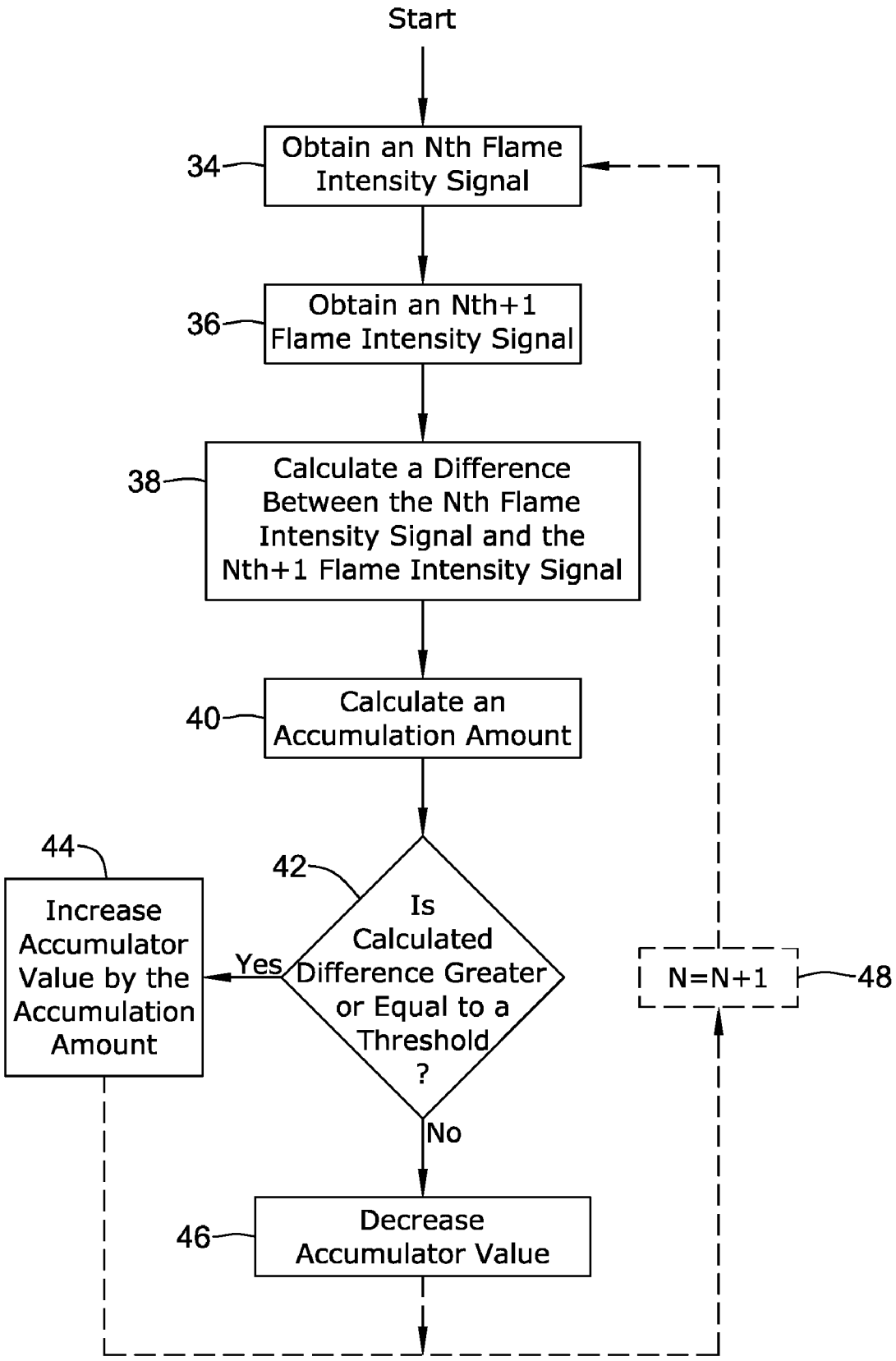
FIG. 5 is a flow diagram showing an illustrative method that may be carried out in operating the illustrative combustion appliance of FIG. 1.

FIG. 5 is a flow diagram showing an illustrative method that may be carried out using combustion appliance 10 (FIG. 1). At block 34, an $n^{th}$ flame intensity signal is obtained. In some cases, "n" is an integer counter value. If desired, controller 16 (FIG. 1) may obtain the $n^{th}$ flame intensity signal from flame sensor 14 (FIG. 1). At block 26, an $n^{th}+1$ flame intensity signal is obtained. In some cases, the $n^{th}+1$ flame intensity signal is obtained temporally after obtaining the $n^{th}$ flame intensity signal. Any desired time interval may pass between obtaining the $n^{th}$ flame intensity signal and the $n^{th}+1$ flame intensity signal.

Control passes to block 38, where controller 16 (FIG. 1) calculates a difference between the $n^{th}$ flame intensity signal and the $n^{th}+1$ flame intensity signal. At block 40, an accumulation amount is calculated. In some cases, the accumulation amount may be based at least partially upon the calculated difference between the $n^{th}$ flame intensity signal and the $n^{th}+1$ flame intensity signal, and/or upon the sign of the calculated difference, i.e., is the difference positive or negative. Other factors that may influence the accumulation amount include one or more of an average flame intensity, a combustion fan speed and/or a firing rate history.

Control passes to decision block 42, where controller 16 determines if the calculated difference (from block 38) is equal to or greater than a predetermined threshold. The predetermined threshold may, for example, be based at least in part on the identity and/or operating characteristics of combustion appliance 10 (FIG. 1).

If the calculated difference meets or exceeds the predetermined threshold, control passes to block 44 where an accumulator value is increased by an amount equal to the accumulation amount. If not, control passes to block 46 where the accumulator value is decreased. The amount that the accumulator value is decreased may be based at least in part on the operating characteristics of combustion appliance 10 (FIG. 1). In some cases, the decreased amount may be a constant. In some cases, if the accumulator value exceeds a threshold value, combustion instability is determined. If desired, control may pass from either block 44 or block 46 to an optional block 48. At block 48, counter n is incremented by one, and control reverts to block 34.

Figure 6:
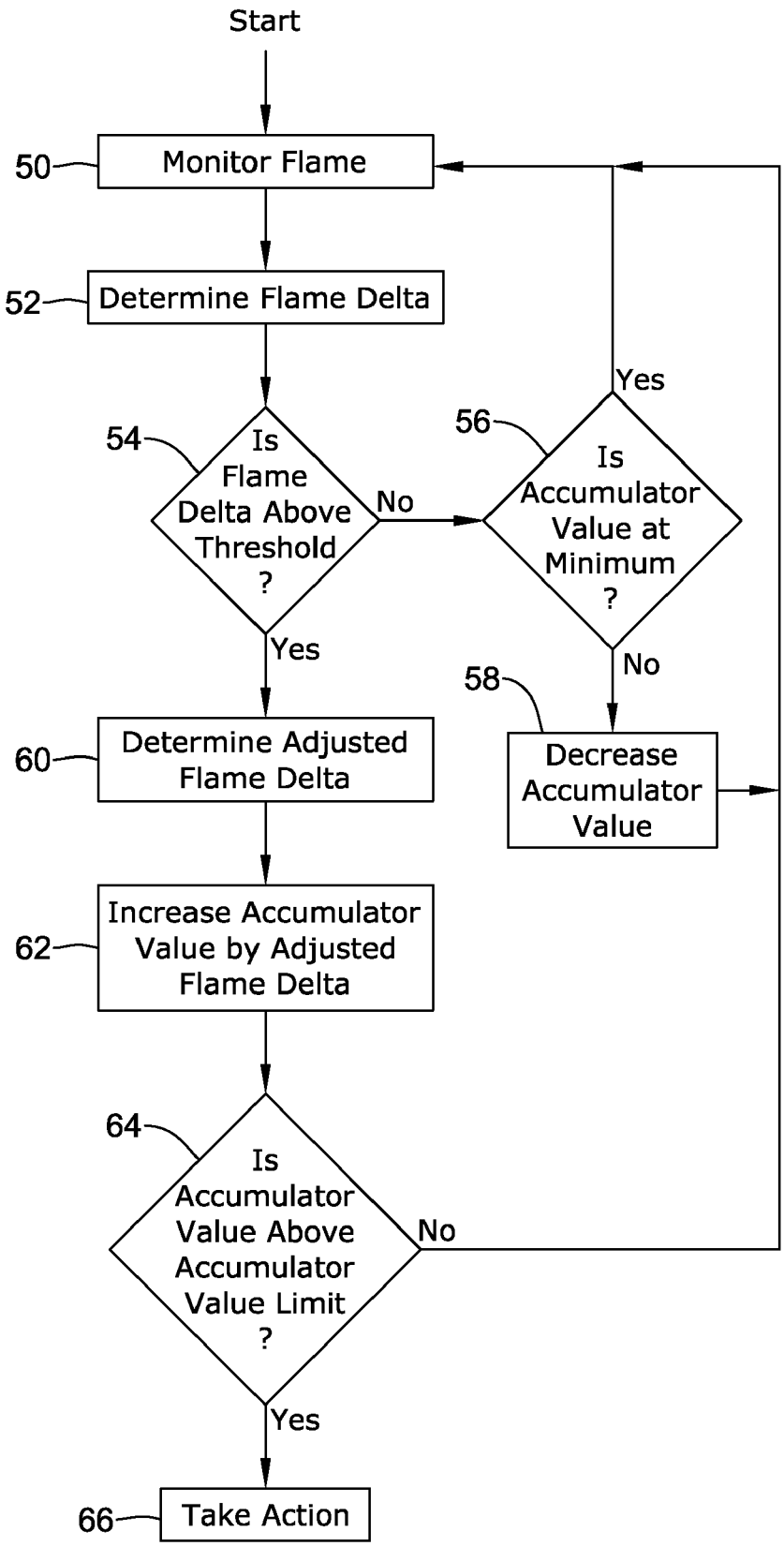
FIG. 6 is a flow diagram showing an illustrative method that may be carried out in operating the illustrative combustion appliance of FIG. 1.

FIG. 6 is a flow diagram showing an illustrative method that may be carried out using combustion appliance 10 (FIG. 1). At block 50, a flame is monitored. In some instances, this may include monitoring signals from flame sensor 14 (FIG. 1). At block 52, a flame delta is determined. In some cases, the flame delta may be a difference between a previous flame sensor signal and a current flame sensor signal. Control passes to decision block 54, where controller 16 (FIG. 1) determines if the flame delta is above a threshold. The threshold may be determined at least in part on the operating characteristics of combustion appliance 10 (FIG. 1).

If the flame delta is not above the threshold, control passes to decision block 56, where controller 16 (FIG. 1) determines if an accumulator value is at a minimum. In some cases, the minimum is set at zero, but this is not required. In some instances, setting a minimum for the accumulator value prevents the accumulator value from artificially hiding an unstable flame situation. For example, if the flame delta was low for a long period of time, the accumulator value could otherwise be lowered well below zero. Then, if the flame delta increases, the accumulator value could fail to reflect this in a timely manner. If the accumulator value is already at the minimum, control reverts to block 50. If not, control passes to block 58 and the accumulator value is decreased, followed by control reverting to block 50.

If at decision block 54, controller 16 (FIG. 1) determines that the flame delta is above the threshold, control passes to block 60 where an adjusted flame delta is determined. In some cases, the flame delta is adjusted, or weighted, to take differing situations into account. For example, some flame signals may warrant a more quickly increased accumulator value, and thus the adjusted flame delta may be larger than the actual flame delta. In some cases, a more slowly increased accumulator value may be beneficial.

At block 62, the accumulator value is increased by the adjusted flame delta. Control passes to decision block 64, where controller 16 determines if the accumulator value is above an accumulator value limit. If the accumulator value is not above the accumulator value limit, control reverts to block 50. However, if the accumulator value is above the accumulator value limit, control passes to block 66 where one or more actions are taken. In some cases, it may be possible to correct the combustion instability by changing one or more functional parameters such as firing rate, combustion fan speed and the like. In some instances, combustion may be stopped, either before and/or after attempting to correct the combustion instability.

Figure 7:
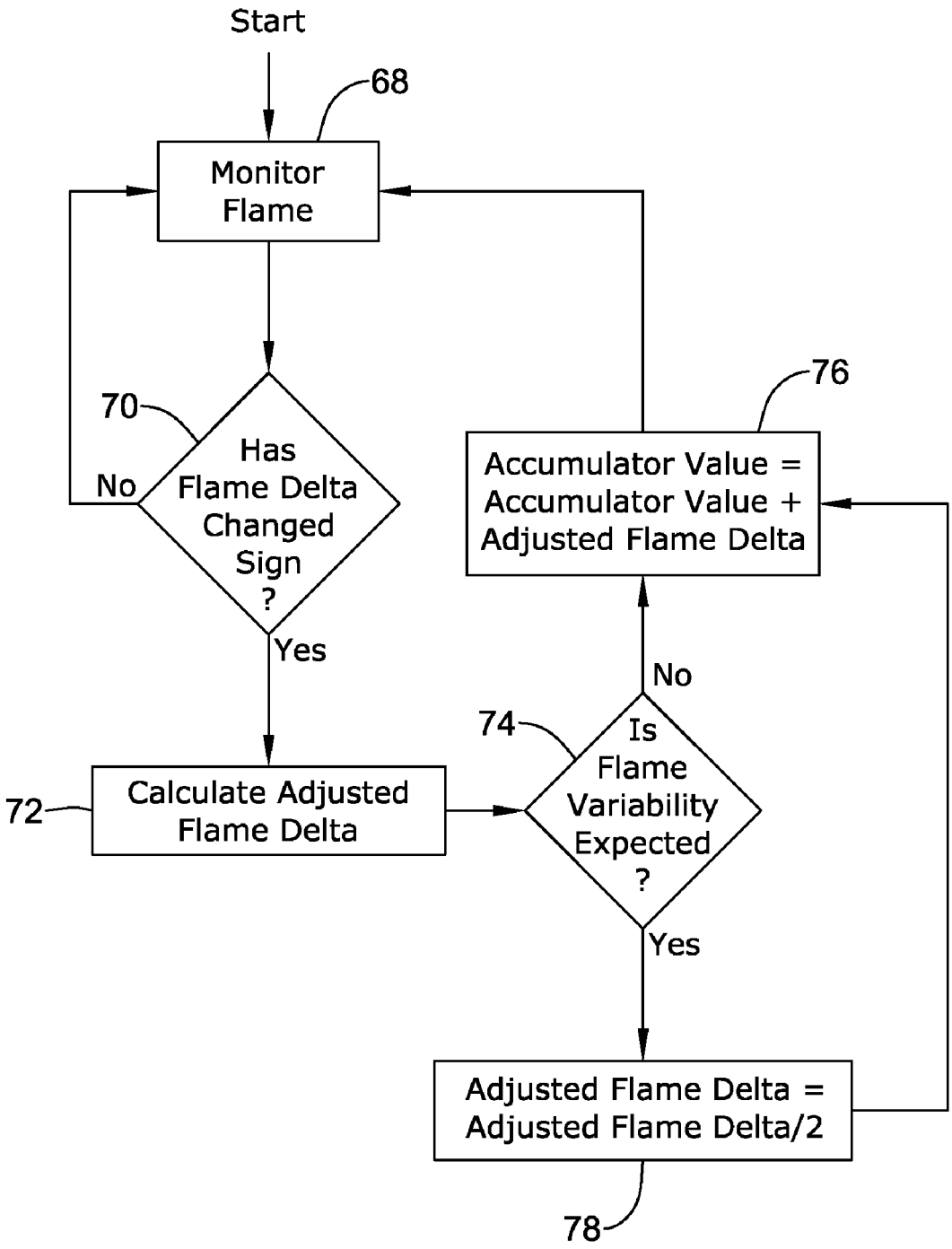
FIG. 7 is a flow diagram showing an illustrative method that may be carried out in operating the illustrative combustion appliance of FIG. 1.

FIG. 7 is a flow diagram showing an illustrative method that may be carried out using combustion appliance 10 (FIG. 1). In particular, FIG. 7 illustrates some of the considerations that may be involved in determining an adjusted flame delta as referenced at block 60 of FIG. 6. At block 68, a flame is monitored. At block 70, controller 16 (FIG. 1) determines if the flame delta has changed sign (e.g. increasing-to-decreasing, or decreasing-to-increasing). If the sign has not changed, i.e., the flame intensity is still increasing or is still decreasing, control reverts to block 68. However, if the flame delta has changed sign, i.e., the flame intensity has changed directions, control passes to block 72 and an adjusted flame delta is calculated.

At decision block 74, controller 16 (FIG. 1) determines if flame variability is to be expected. In some cases, flame variability may be expected if, for example, the combustion fan speed is low and/or the firing rate has recently changed (such as within the last 60 seconds). If flame variability is not expected, control passes to block 76 and the accumulator value is increased by the adjusted flame delta. However, if flame variability is expected, control passes to block 78 and the adjusted flame delta is divided by two before control passes to block 76.

Figure 8:
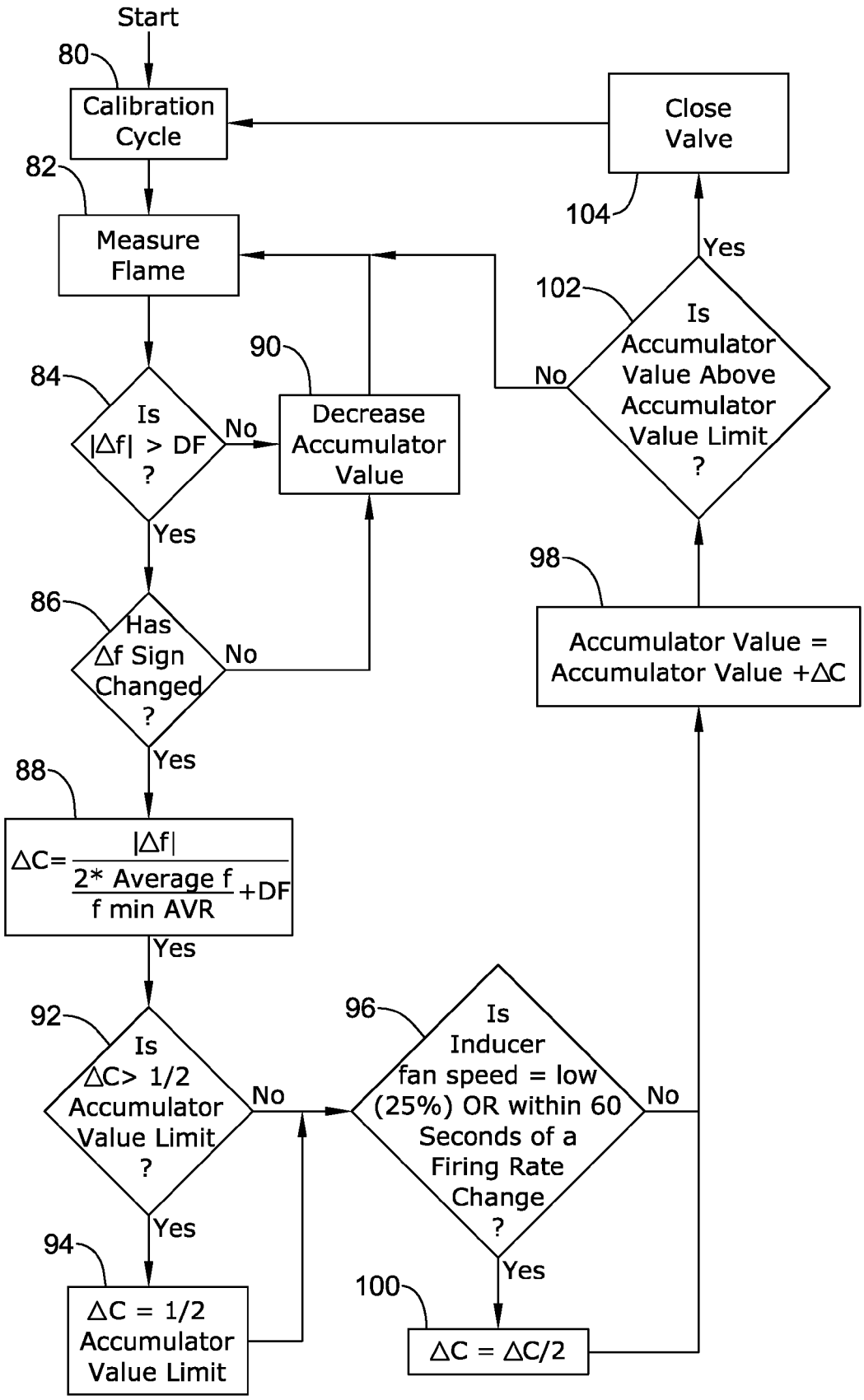
FIG. 8 is a flow diagram showing an illustrative method that may be carried out in operating the illustrative combustion appliance of FIG. 1.

FIG. 8 is a flow diagram showing an illustrative method that may be carried out using combustion appliance 10 (FIG. 1). At block 80, controller 16 (FIG. 1) executes a calibration cycle. During the calibration cycle, controller 16 may determine acceptable ranges for flame intensity at one or more fire rates. These values include an average flame intensities at a minimum firing rate, as well as average flame intensities at other firing rates and may be used subsequently, as will be discussed. Control passes to block 82, where controller 16 obtains a flame measurement.

At decision block 84, controller 16 (FIG. 1) compares the flame measurement to one or more previous flame measurements to determine if an absolute value of the change in flame measurement is above a predetermined threshold DE (Delta in Flame intensity). If the change in flame measurement is above the threshold DF, control passes to decision block 86 where controller 16 determines if the flame measurements have changed directions, i.e., the flame measurement had been decreasing but is now increasing, or the flame measurement had been increasing but is now decreasing. If the flame measurement has changed direction, control passes to block 88 and an adjusted flame delta (ΔC) is calculated. If the flame measurement has not changed direction, control passes to block 90 and the accumulator value is decreased. In some cases, the accumulator value will not be decreased if already at a particular minimum value. Control then reverts to block 82.

After an adjusted flame delta (ΔC) is calculated at block 88, control passes to decision block 92, where controller 16 (FIG. 1) determines if the ΔC is excessive. In some cases, decision block 92 may be useful in addressing extreme situations. If ΔC is deemed excessive, it is limited to half the accumulator limit value at block 94, and control passes to decision block 96. If ΔC is not deemed excessive, control passes directly to decision block 96.

At decision block 96, controller 16 (FIG. 1) determines if flame variability is to be expected. Flame variability may be expected if, for example, the combustion blower is at low speed or if there has recently been a change in firing rate. If no variability is expected for these or other reasons, control passes to block 98 where ΔC is added to the accumulator value. However, if variability is expected, control passes to block 100 where ΔC is cut in half before being added to the accumulator value at block 98.

Control passes to decision block 102, where controller 16 (FIG. 1) determines if the accumulator value has exceeded an accumulator value limit. If not, control reverts to block 82 where the flame is again measured. However, if the accumulator value has exceeded the accumulator value limit, control passes to block 104 where the gas valve is closed. In some cases, control may revert to block 80 where a calibration cycle is again run.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A method of operating a combustion appliance, the method comprising the steps of:

obtaining an $n^{th}$ flame intensity signal having a first electrical characteristic using a flame sensor;

obtaining an $n^{th}+1$ flame intensity signal having a second electrical characteristic using the flame sensor;

calculating a difference between the first electrical characteristic of the $n^{th}$ flame intensity signal and the second electrical characteristic of the $n^{th}+1$ flame intensity signal;

calculating an accumulation amount based, at least in part, on the calculated difference between the first electrical characteristic of the $n^{th}$ flame intensity signal and the second electrical characteristic of the $n^{th}+1$flame intensity signal;

increasing an accumulator value by the accumulation amount if the difference is above a threshold and decreasing the accumulator value if the difference is below the threshold; and taking action by changing operation of the appliance if the accumulator value reaches an accumulator value limit.

2. The method of claim 1, wherein calculating an accumulation amount is at least partially dependent upon a sign of the calculated difference.

3. The method of claim 1, wherein calculating an accumulation amount is at least partially dependent upon an average flame intensity.

4. The method of claim 1, wherein calculating an accumulation amount is at least partially dependent upon a combustion fan speed.

5. The method of claim 1, wherein calculating an accumulation amount is at least partially dependent upon a firing rate history.

6. The method of claim 1, wherein decreasing the accumulator value comprises decreasing the accumulator value by a predetermined amount.

* * * * *